United States Patent [19]

Perk

[11] Patent Number: 4,680,910

[45] Date of Patent: Jul. 21, 1987

[54] HOLLOW-LOUVERED CEILINGS

[76] Inventor: William E. Perk, 3419 E. 65th St., Cleveland, Ohio 44127

[21] Appl. No.: 778,369

[22] Filed: Sep. 20, 1985

[51] Int. Cl.[4] ..... E04B 5/52; E04C 2/42

[52] U.S. Cl. ..... 52/489; 52/664; 52/668

[58] Field of Search ..... 52/664, 666, 667, 668, 52/489, 484, 665

[56] References Cited

U.S. PATENT DOCUMENTS

| | | | |
|---|---|---|---|
| 2,886,859 | 5/1959 | Siering | 52/664 |
| 2,939,543 | 6/1960 | Zingone | 52/664 |
| 3,016,997 | 1/1962 | Price . | |
| 3,093,221 | 6/1963 | Purdy | 52/665 |
| 3,378,976 | 4/1968 | Meredith | 52/664 |
| 4,492,066 | 1/1985 | Lalonde | 52/668 |
| 4,532,749 | 8/1985 | Perk | 52/668 |
| 4,601,153 | 7/1986 | Dunn et al. | 52/666 |

*Primary Examiner*—William F. Pate, III
*Assistant Examiner*—Caroline D. Dennison
*Attorney, Agent, or Firm*—Woodling, Krost & Rust

[57] ABSTRACT

A louvered ceiling construction especially suited for parabolic louvers is claimed. Runners, of the same hollow channel shape as the louver members, are provided with openings into which extensions carried by the louver members are secured. The extensions are entirely concealed within the channels so that a smooth and uniform appearance is presented from below.

2 Claims, 3 Drawing Figures

FIG. 1
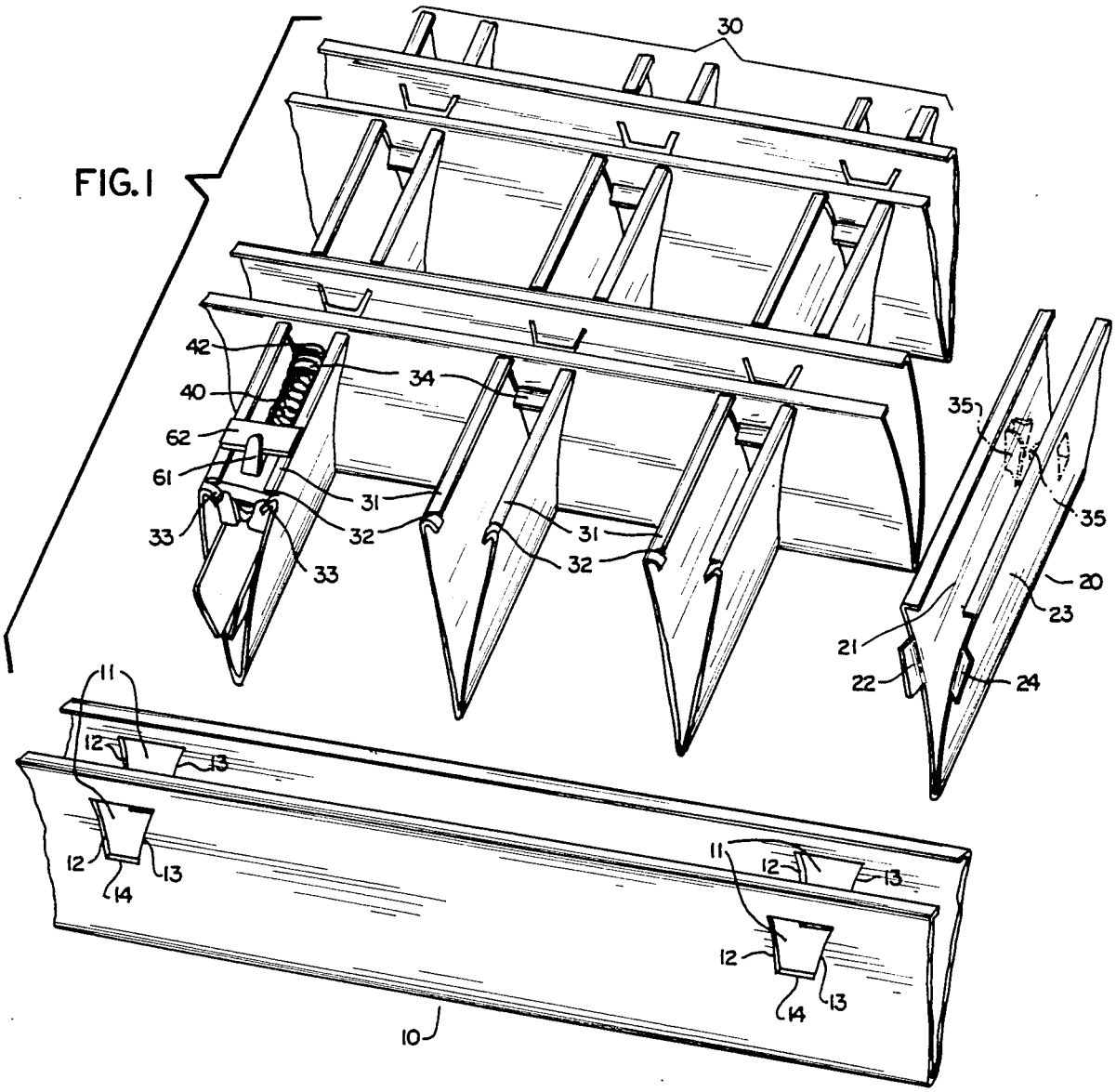
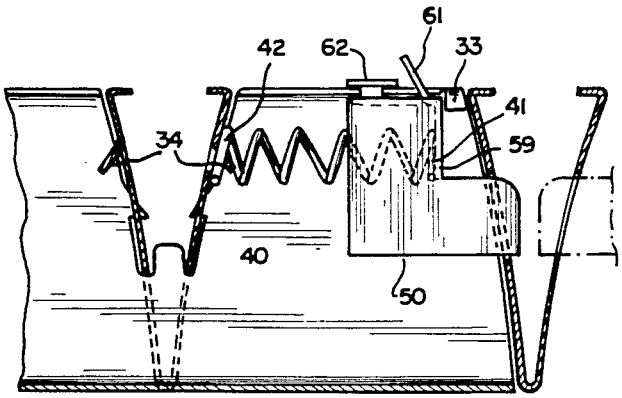
FIG. 2
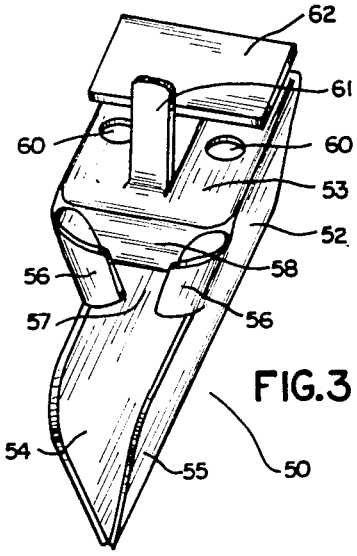
FIG. 3

HOLLOW-LOUVERED CEILINGS

This invention relates to louvered ceilings, that is, false ceilings with louvers suspended below a normal ceiling. More particularly, the invention concerns an improved method of supporting channel-shaped louvers from runners having a construction similar in appearance to the louver members, so that a uniform appearance is presented to view from below.

In louvered ceilings, the "louvers" are panels comprised of intersecting vertical slot-like members. The intersections form open cells, usually rectangular, through which light may pass from light sources above the louvered ceiling, or be reflected from sources in the ceiling Early louver members were generally thin solid slats, but an increasingly popular type of design uses slats which are hollowed or channel-shaped in some respect. This gives a more massive appearance while saving weight and expense. For example the louver members may have the cross-sectional shape of a squared-off "U", as in U.S. Pat. Nos. 4,034,534 to Taylor and 4,532,749 to the inventor herein. These channels have two vertical sidewalls and a base wall joining them at the bottom. These patents are directed to the means by which the louver panels are supported, by their protruding louver members, upon long "runners", channels of similarly "U-shaped" cross-section.

A great advantage inheres in the Taylor and Perk ceilings' support of their louvers with runners which look the same from below as the louver members. This feature is not commonly found. For example, gridwork of inverted T-bars is commonly used for suspending false ceilings, including those of the louvered type. But since the inverted T does not appear the same as the panel elements, a modular appearance is seen from below. That is, the ceiling appears as an array of units separated by the T-bars. In the Taylor and Perk ceilings referred to above there is no such modularity because the supporting runners look the same as the louver members, and so the entire ceiling seems uniform from below.

It would be desirable to achieve the same non-modular appearance in a ceiling having louver members which were hollow but not U-shaped, in particular, louver members having a channel cross-section substantially wider at the top than at the bottom. The "parabolic" louver, the members of which are paraboloid in shape so that they reflect all light directly downward, is an especially important example. Another example would be a straight V-shaped channel. In general, we shall mean by "V-channel" any such channel in which the sidewalls are not vertical but are canted toward each other for at least some portion of their areas. Until the present invention, non-modularity has not been satisfactorily achieved by any louvered ceiling of V-channel.

SUMMARY OF THE INVENTION

The present invention is a louvered ceiling which is supported by long parallel runners of hollow channel. The portions of the ceiling which lie between the runners are constructed of intersecting members of the same channel shape. All channel sidewalls meet in closely abutting joints.

The close abutment of the members is achieved in the invention by providing openings in the runners, into which extensions on the other elements are secured by spring action. This construction is especially advantageous where the members are V-channel—for example, parabolic.

In the presently preferred embodiment, the runners are spanned by shorter perpendicular cross-members which have terminal tab-like extensions on each sidewall. The tabs are held in the runner openings by the spring force urging the two sidewalls apart. Then louver panels are mounted in the remaining spaces by means of spring-driven plungers. These plungers, hidden within the louver panels, extend into runner openings identical to those which receive the cross-member tabs.

The use of spring action to secure the supported elements into the runner openings makes possible a non-modular ceiling in which all connections are hidden from below. Moreover, it provides not only for positive support of all members against displacement in any direction, but also for ease of installation, as the louver panels can simply be "snapped" in from below.

Accordingly, it is an object of this invention to provide a hollow-louvered ceiling with concealed but positive support of all elements from the main runner, and ease of assembly.

Another object of the invention is to provide the first parabolic louvered ceiling which is non-modular in appearance from below.

These and other objects of the invention will appear from a consideration of the claims herein, the description to follow of a preferred embodiment, and the drawings in which FIG. 1 is an isometric drawing, from above, of the preferred embodiment of the invention in partly exploded form, FIG. 2 is a side elevational view, partly in section, of the spring-mounted plunger arrangement of the preferred embodiment in assembled form, and FIG. 3 is an isometric drawing, from above, of the plunger member.

DESCRIPTION OF THE PREFERRED EMBODIMENT

FIG. 1 shows the presently preferred embodiment of the invention, in which the visible members are constructed of V-channel, in this case parabolically curved, with a narrow inwardly turned lip on top of each sidewall. The runner 10 has cut into its sidewalls opposed window-like openings 11, each having side edges 12 and 13 and a bottom edge 14.

Cross-member 20 is shown as if it were about to be mounted into one of the farther windows 11. Cross-member 20 is constructed from a sheet material, preferably metal, of such thickness that it is substantially rigid when not under pressure, but is somewhat springy, so that its sidewalls can be squeezed towards each other by manual pressure. One sidewall 21 has an outwardly bent tab 22 on its end and the other sidewall 23 has similar tab 24. To secure cross-member 20 to runner 10 the sidewalls 21 and 23 are simply compressed together until tabs 22 and 24 may be inserted into opening 11. Side edges 12 and 13 of the opening are cut at the appropriate distance and shape to permit sidewalls 21 and 23 to assume substantially their normal distance apart when compression is released. The cross-member 20 is then supported by the edges 12 and 13 of runner opening 11 and by the bottom edge 14 of the opening as it contacts the bottoms of tabs 22 and 24. The other end of cross-member 20, not shown here, is secured to another runner parallel to the runner 10 shown here, preferably in the same fashion. Other cross-members 20 are mounted at regular intervals between runners 10.

The rectangular spaces remaining between the parallel runners 10 and cross-members 20 are filled by louver panels. A corner portion of one such louver panel 30 is seen in FIG. 1. Louver panel 30 is made from the same V-channel as are runners 10 and cross-members 20. The louver members interlock at "egg-crate" joints in a manner well-known to those skilled in the art. (See, for example, the cited patent to Taylor.)

The louver panels 30 are secured to runners 10 by means of springs 40 and spring-driven plungers 50. FIG. 2 shows an arrangement of plunger 50 and spring 40 as they are held in the end of a louver channel; FIG. 3 shows the plunger itself in its presently preferred form.

The body of plunger 50, as best seen in FIG. 3, may conveniently be constructed of a single piece of sheet metal bent into four planes. The first three planes are triangular in cross-section, comprising a V-shaped bottom section of walls 51 and 52, and an upper horizontal section wall 53, joining the two walls 51 and 52 of the V. Walls 51 and 52 are provided with projections 54 and 55, respectively, which enter one of the runner openings 11. Projections 54 and 55 are preferably rounded on their upper edges for convenience in assembling the ceiling. It is not necessary for the projections 54 and 55 to fit exactly into opening 11, but only for their lower edges to rest on edge 14 so as to support louver panel 30 at the desired height.

Portions of walls 51, 52 and 53, labelled respectively as 56, 57 and 58, are bent perpendicularly into a fourth plane to form a front spring support structure 59, shown in FIG. 2. The purpose of this structure is to provide a supporting wall for one end 41 of spring 40. Alternatively, upper wall 53 may be provided with holes 60 to accommodate one or two pop rivets or the like which will support the spring 40. The other end 42 of spring 40 is supported against the sidewall of the intersecting channel member and maintained in position by an outwardly bent horizontal tab 34 around which it rests. If it is desired to use the spring-driven plunger arrangement on cross-members 20, inwardly bent vertical tabs 35 may be provided in cross-members 20, as shown in phantom in FIG. 1.

A release lever 61 protrudes upwardly from upper wall 53. Its function is to compress spring 40 in the event it is desired to remove one or more of louver panels 30. Preferably, a single louver panel will have two of its channel ends provided with spring-driven plungers on each of the two opposed panel sides adjacent to a runner 10. The other two opposed sides simply abut the cross-members 20. Removal of the louver panel is effected by compressing the two release levers 61 on one side, whereupon the panel may be lowered on that side and pulled away without further effort.

Fastened to the top of upper wall 53 is a retainer bar 62 which extends across wall 53 and lies above wall 53 at its ends, so that a space is formed between wall 53 and the outer ends of retainer bar 62. This space may be formed by mounting retainer bar 62 with a fastening means which holds wall 53 and retainer bar 62 apart, or it may be formed by bending wall 53 down or retainer bar 62 up. It is presently preferred to bend wall 53 down somewhat on both sides and to fasten retainer bar 62 to wall 53 by welding. When the ceiling is assembled, the ends of retainer bar 62 slide over the tops of lips 31 (see FIG. 1), holding the plunger in the proper orientation for assembly.

The louver channel members which are to abut the runner 10 on their ends have small slots 32 near the ends of lips 31. In those members which are to bear spring-driven plungers 50, the lips 31 are bent downwardly at slots 32 to form detents 33. These keep the plunger and spring structures in place until the ceiling is assembled.

The invention has been disclosed in its presently preferred form but it should be understood that many modifications may be made without departing from the spirit of the invention as claimed. For example, any shape of hollow channel can be employed although the invention is most advantageously used in V-channel (as defined herein) louvered ceilings. Two kinds of spring-fitting of channel ends into runner openings have been disclosed, either of which may be used for all the spring-mounted connections in the ceiling. Other forms will present themselves to those skilled in the art.

What is claimed is:

1. In a louvered ceiling comprising panels of channel-shaped louver members suspended from channel-shaped runners, the improvement comprising a channel-shaped runner having a first sidewall and having an opening in said first sidewall;

a channel-shaped louver member having second and third sidewalls with ends abutting said first sidewall, such that said opening in said first sidewall lies between said two abutting ends of said second and third sidewalls;

extension means carried by said channel-shaped louver member, said extension means being spring-movable and extending into said opening in said first sidewall;

said extension means being insertable into and removable from said opening in said first sidewall without deformation of said first sidewall and said extension means being concealed within said runner or said louver member, or within both, after said louvered ceiling is installed; and said extension means comprising a spring and a plunger member carried within said channel-shaped louver member, said spring tending to urge said plunger member in a direction parallel to said channel-shaped louver member and toward the interior of said channel-shaped runner.

2. The improved louvered ceiling of claim 1 and further comprising release means carried by said spring-driven plunger member, said release means permitting the compression of said spring.

* * * * *